US005415896A

United States Patent [19]

Mulvihill et al.

[11] Patent Number: 5,415,896

[45] Date of Patent: May 16, 1995

[54] RAILROAD WHEEL FLANGE LUBRICATING METHOD

[75] Inventors: Mark A. Mulvihill, Beaumont; Arnold C. Witte; Frank K. Botz, both of Port Neches, all of Tex.

[73] Assignee: Texaco Inc., White Plains, N.Y.

[21] Appl. No.: 277,812

[22] Filed: Jul. 20, 1994

[51] Int. Cl.[6] ..... B05D 3/02

[52] U.S. Cl. ..... 427/388.4; 134/2; 252/49.3; 252/52 A; 422/7; 428/487

[58] Field of Search ..... 134/2; 252/49.3, 52 A; 427/388.4; 428/457; 422/7

[56] References Cited

U.S. PATENT DOCUMENTS

| | | | |
|---|---|---|---|
| 4,606,833 | 8/1986 | Schuettenberg et al. | 252/52 A |
| 5,286,300 | 2/1994 | Hnatin et al. | 252/52 A |
| 5,342,531 | 8/1994 | Walters et al. | 252/52 A |

*Primary Examiner*—Michael Lusignan

*Attorney, Agent, or Firm*—James L. Bailey; Kenneth R. Priem; Richard A. Morgan

[57] ABSTRACT

Railroad wheel flange lubricating is carried out with a lubricating composition which is particularly useful in a locomotive-mounted applicator. The water base lubricant comprises a compatible blend of two polyoxyalkylene glycols, one a synthetic lubricant and the other a synthetic thickener. The lubricating composition is persistent and environmentally innocuous.

3 Claims, No Drawings

RAILROAD WHEEL FLANGE LUBRICATING METHOD

BACKGROUND OF THE INVENTION

1. Field Of The Invention

The invention is a method of lubricating a railroad wheel flange in contact with the gage face of a rail. The method relies on an aqueous lubricating composition comprising two polyoxyalkylene glycols, one a synthetic thickener and the other a synthetic lubricating oil.

2. Description Of The Related Art

Trackside (wayside) applicators are used to apply lubricant to curved rail in order to reduce friction between a wheel flange and the rail. A pump in the trackside applicator is mechanically activated as a train passes and an amount of lubricant is applied to the gage face. The gage face is the term used in the art for the vertical rail surface engaging the wheel flange that is not the top, running surface of the rail.

It has been found that the application of lubricant to straight (tangent) rail is also cost effective. The benefits include fuel saving, improved wheel and rail wear and fewer derailments.

Trackside (wayside) applicators are now being supplemented with locomotive mounted applicators which run on trucks drawn along the track. These on-board applicators apply lubricant to the rail gage face. S. Kumar U.S. Pat. No. 4,930,600 et al. discloses an Intelligent On-Board Rail Lubrication System For Curved And Tangent Track.

There is a need in the art for lubricants for use in on-board rail gage face applicators.

SUMMARY OF THE INVENTION

A method has been found for lubricating a railroad wheel flange in contact with a rail gage face. A lubricating composition is applied to the wheel flange in an amount of .001 to 1.0 gallon/minute. The lubricating composition comprises a first polyoxyalkylene glycol thickener, a second polyoxyalkylene glycol lubricating oil and water.

The first polyoxyalkylene glycol comprises a linear copolymer of 70 to 80 wt % ethylene oxide and the balance propylene oxide. It has a molecular weight of 8000 to 12,000. This first polyoxyalkylene glycol comprises 0.2 wt% to 6.0 wt% of the composition.

The second polyoxyalkylene glycol comprises a linear copolymer of 70 to 80 wt % ethylene oxide and the balance propylene oxide. It has a molecular weight of 2000 to 3000. This second polyoxyalkylene glycol comprises 50 wt % to 80 wt % of the composition.

The composition is persistent and flows through a locomotive mounted applicator at temperatures down to −30° F. (−34.4° C.). It is also water-soluble and environmentally innocuous.

DETAILED DESCRIPTION OF THE INVENTION

The lubricating method relies on an aqueous mixture of two compatible polyoxyalkylene glycols. Both are represented by the general formula:

$$HO-(CH_2\underset{\underset{R}{|}}{C}HO)_n-H$$

wherein for each monomer R is independently hydrogen or methyl, and n is defined by the molecular weight of the glycol.

The first polyoxyalkylene glycol is a thickener comprising 0.2 wt % to 6.0 wt %, preferably 1.5 wt % to 4.5 wt % of the composition. This first polyoxyalkylene glycol is a linear copolymer of 70% to 80%, typically 75% ethylene oxide and 20% to 30% propylene oxide. It has an average molecular weight of 8000 to 12,000, typically 10,000 to 11,000.

A sample of UCON® 75-H-90000 has an average molecular weight of approximately 10,300 and a neat viscosity of approximately 90,000 Saybolt Universal Seconds (SUS) at 37.8° C. The only side chains on the essentially linear copolymer are the methyl groups of the propylene oxide. This thickener is available commercially under the trade name UCON® 75-H-90000.

The second polyoxyalkylene glycol comprises 50 wt % to 80 wt %, preferably 60 wt % to 70 wt % of the composition. The second polyoxyalkylene glycol is a linear copolymer of 70% to 80%, typically 75% ethylene oxide and 20% to 30% propylene oxide. It has an average molecular weight of 2000 to 3000. A commercially available sample of UCON® 75-H-1400 had a neat viscosity of 1400 Saybolt Universal Seconds (SUS) at 37.8° C.

TEXOX® WL-1400 has the chemical structure:

$$H(OCH_2CH_2)_x(O(CH_3)CHCH_2)_y(OCH_2CH_2)_xOH$$

wherein: x is at least 1 and the sum of x+y yields a copolymer having a molecular weight of 2500.

The aqueous mixture will typically comprise a rust inhibitor. Actracor® M, a cathodic amine borate rust inhibitor was used in Example 1. Other suitable cathodic rust inhibitors include: phosphates, polyphosphates, sodium benzoate, quartenary amines, borax, amine borates, sodium borates, sodium molybdate, alkali metal nitrates, alkyl carboxylates, benzo tolyl triazoles, sulfonates and zinc salts. Suitable organic rust inhibitors include: morpholine, amines, ammonia, ethylenediamines, hydrazine, immidazolines, formamide, and alkanolamines. Anodic rust and corrosion passivators include: carbonates, bicarbonates, sodium silicates, metasilicates, sodium chromates, calcium hydroxide, calcium bicarbonates, sodium nitrate, and sodium chromate.

The lubricating compositions are formulated by methods well-known in the art. That is, the formulation may be carried out continuously. In the alternative, the compositions can be formulated in a semiworks by hand. The two polyoxyalkylene glycol substituents are weighed out individually on a scale. The less viscous polyoxyalkylene glycol and deionized water are added to a steam jacketed stainless steel kettle at ambient temperature to about 150° F. (65.5° C.), with stirring. Additives such as a rust inhibitor and biocide may then be added. When a homogeneous mixture is achieved, the polyoxyalkylene glycol thickener is added in aliquots with continuous stirring to maintain homogeneity. The result is the final lubricating composition. This composition is cooled to room temperature, sampled, canned and labeled.

At the point of use, a locomotive mounted applicator is drained, flushed and then refilled with the lubricating composition of the invention. In the Best Mode contemplated by Inventors, the composition is used in the locomotive mounted lubricator described in S. Kumar U.S.

Pat. No. 4,930,600 et al. to lubricate a railroad wheel flange contacting a rail gage face.

The invention is shown by way of example.

EXAMPLE 1 AND COMPARATIVE EXAMPLE 2

Two pounds of the lubricating composition of the invention was formulated by combining the substituents and heating with stirring for 30 minutes at 130° F. (54.4° C.). This lubricating composition had the following ingredients:

| | EXAMPLE 1 |
|---|---|
| Polyoxyalkylene glycol[1] | 64.46 wt % |
| Thickener[2] | 3.00 wt % |
| Deionized water | 32.14 wt % |
| Rust inhibitor[3] | 0.40 wt % |

[1]TEXOX ® WL-1400, MW 2500
[2]UCON ® 75H 90,000
[3]Actracor ® M, a cathodic amine borate inhibitor The lubricating composition had the following physical properties compared to a naphthenic 55 SUS base oil (N55 Pale Oil).

| | EXAMPLE 1 | COMPARATIVE EXAMPLE 2 |
|---|---|---|
| Appearance | bright, clear | bright, clear |
| vis. @ 40° C. | 135.9 cSt | 10.0 cSt |
| vis. @ 100° C. | — | 2.5 cSt |
| Pour Point | −35° F. | −50° F. |
| Chip Rust Test | Pass | — |
| Flash Point, COC | >300° F. | 315° F. |

Flash Point, ASTM D-92-85
Pour Point, ASTM D-97-87

In the Chip Rust Test, approximately 15 ml portions of clean, dry cast iron chips were soaked in the composition. The fluid was drained and the chips were spread evenly over the bottom of a 100 mm diameter Petri dish. After drying for 16 hours, the chips were rated for rust. The rusting of 11 or more chips constituted a failure of the fluid.

Both lubricants were tested in the Illinois Institute of Technology (IIT) Wheel Rail Simulation rig. This test rig is a ¼ scale wheel and rail test rig for rail lubrication testing. Both lubricants exceeded 220 minutes in a test of gage face lubrication.

EXAMPLES 3, 4, 5 AND 6

Four, 0.25 gallon batches of the lubricating composition were formulated by combining and stirring the components of Example 1 at 100° .F (37.8° C.) for 20 minutes. The batches were sampled and tested for physical properties.

| | EXAMPLE 3 | EXAMPLE 4 | EXAMPLE 5 | EXAMPLE 6 |
|---|---|---|---|---|
| Polyoxyalkylene glycol | 67.07 wt % | 66.93 wt % | 66.80 wt % | 66.66 wt % |
| Thickener | 0.40 | 0.60 | 0.80 | 1.00 |
| Deionized water | 3.53 | 32.47 | 32.40 | 32.34 |
| Appearance | hazy | hazy | sl. haze | v. sl. haze |
| vis. @ 40° C. | 96.1 cSt | 96.9 cSt | 99.5 cSt | 101.4 cSt |
| Specific Gravity @ 60° F. | 1.096 | 1.096 | 1.093 | 1.096 |
| Pour Point | −35° F. | −35° F. | −40° F. | −45° F. |

The examples all demonstrate a useful viscosity at 40° C.

EXAMPLES 7 AND 8

Two batches of the lubricating composition were formulated by stirring the components of Example 1 together at 180° F. (82.2° C.) for 30 minutes. The batches were sampled and tested for physical properties.

| | EXAMPLE 7 | EXAMPLE 8 |
|---|---|---|
| Polyoxyalkylene glycol | 66.16 wt % | 64.66 wt % |
| Thickener | 1.50 | 3.00 |
| Deionized water | 32.34 | 32.34 |
| Appearance | v. sl. haze | v. sl. haze |
| vis. @ 40° C. | 128.5 cSt | 170.4 cSt |
| Pour point | −25° F. | −30° F. |

The examples demonstrate the effect of the thickener on pour point.

EXAMPLES 9 AND 10

Two batches of the lubricating composition were formulated by stirring the components of Example 1 together at 50° F. (65.5° C.) for 45 minutes. The batches were sampled and tested for physical properties.

| | EXAMPLE 9 | EXAMPLE 10 |
|---|---|---|
| Polyoxyalkylene glycol | 64.46 wt % | 64.46 wt % |
| Thickener | 3.00 | 3.00 |
| Deionized water | 32.34 | 32.14 |
| Rust Inhibitor | 0.20 | 0.40 |
| Biocide Triadine ® 10 | 0.10 | 0 |
| Appearance | bright, clear | bright, clear |
| vis. @ 40° C. | 165.2 cSt | 132.4 cSt |
| Pour point | −35° F. | −40° F. |
| Chip Rust Test | Pass | Pass |

The thickening composition of Example 9 was environmentally evaluated as follows:

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A method of lubricating a railroad wheel flange in contact with a rail gage face comprising:

applying a lubricating composition in an amount of 0.001 to 1.0 gallon/minute, the lubricating composition comprising:

0.2 wt % to 6.0 wt % of a first polyoxyalkylene glycol comprising of a linear copolymer of 70 to 80 wt % ethylene oxide and propylene oxide, the first polyoxyalkylene glycol having a molecular weight of 8000 to 12,000, 50 wt % to 80 wt % of a second polyoxyalkylene glycol comprising a linear copolymer of 70 to 80 wt % ethylene oxide and propylene oxide, the second polyoxyalkylene glycol having a molecular weight of 2000 to 3000, and water.

2. The method of claim 1 wherein the first polyoxyalkylene glycol comprises 1.5 wt % to 4.5 wt % and the second polyoxyalkylene glycol comprises 60 wt % to 70 wt % of the composition.

3. A method of lubricating a railroad wheel flange in contact with a rail gage face comprising:

applying a lubricating composition in an amount of 0.001 to 1.0 gallon/minute, the lubricating composition comprising:

1.5 wt % to 4.5 wt % of a first polyoxyalkylene glycol consisting of a linear copolymer of 75 wt % ethylene oxide and propylene oxide, the first polyoxyalkylene glycol having a molecular weight of 10,000 to 11,000, 60 to 70 wt % of a second polyoxyalkylene glycol consisting of a linear copolymer of about 75 wt % ethylene oxide and propylene oxide, the second polyoxyalkylene glycol having a molecular weight of about 2000 to 3000, and water.

* * * * *